US006772878B1

(12) United States Patent
Liebers et al.

(10) Patent No.: US 6,772,878 B1
(45) Date of Patent: Aug. 10, 2004

(54) PACKAGE CONTAINING READING GLASSES

(75) Inventors: Steven B. Liebers, Norristown, PA (US); Glyn L. Eppy, New York, NY (US)

(73) Assignee: Diversified Products, Inc., Norristown, PA (US)

( * ) Notice: Subject to any disclaimer, the term of this patent is extended or adjusted under 35 U.S.C. 154(b) by 217 days.

(21) Appl. No.: 10/080,897

(22) Filed: Feb. 22, 2002

(51) Int. Cl.[7] ..... A45C 11/04

(52) U.S. Cl. ..... 206/5; 206/471; 206/458

(58) Field of Search ..... 206/5, 6, 461, 206/467, 470, 471, 806, 223, 458; 211/85.1; 351/158

(56) References Cited

U.S. PATENT DOCUMENTS

| | | | | | |
|---|---|---|---|---|---|
| 2,461,792 | A | * | 2/1949 | Weaver | 206/6 |
| 2,720,305 | A | * | 10/1955 | Foster | 206/5 |
| 2,723,745 | A | * | 11/1955 | McNeill | 206/5 |
| 3,116,829 | A | * | 1/1964 | Pacelli | 206/5 |
| 3,381,806 | A | * | 5/1968 | McDonagh | 206/5 |
| D223,784 | S | | 6/1972 | Rios | |
| 4,749,082 | A | * | 6/1988 | Gardiner et al. | 206/461 |
| 4,976,532 | A | | 12/1990 | Nyman | |
| 5,032,019 | A | * | 7/1991 | Burchett | 206/5 |
| 5,056,668 | A | | 10/1991 | Berger | |
| 5,100,006 | A | | 3/1992 | Forrester | |
| 5,249,675 | A | * | 10/1993 | Strauss et al. | 206/5 |
| 5,260,726 | A | | 11/1993 | Nyman | |
| 5,513,744 | A | * | 5/1996 | Yabarra | 206/5 |
| D374,786 | S | | 10/1996 | Liebers | |
| D391,759 | S | | 3/1998 | Zudall | |
| 5,861,941 | A | | 1/1999 | Liebers et al. | |
| D429,417 | S | | 8/2000 | Liebers et al. | |
| 6,257,724 | B1 | | 7/2001 | Liebers | |
| 6,302,369 | B1 | | 10/2001 | Liebers et al. | |
| 6,345,716 | B1 | * | 2/2002 | Chapman | 206/471 |
| 6,478,146 | B1 | * | 11/2002 | Chapman | 206/5 |

* cited by examiner

*Primary Examiner*—Luan K. Bui
(74) *Attorney, Agent, or Firm*—Caesar, Rivise, Bernstein, Cohen & Pokotilow, Ltd.

(57) ABSTRACT

A transparent plastic package containing a pair of non-prescription reading glasses. The temples of the reading glasses pass through openings in the rear wall of the package. The package includes a nose notch. The reading glasses can be tested by a consumer, while in the package, by opening the temples, placing her nose in the notch and placing the temples over her ears. The consumer can then look through the lenses of the reading glasses, to test them for proper magnification.

11 Claims, 8 Drawing Sheets

PACKAGE CONTAINING READING GLASSES

BACKGROUND OF THE INVENTION

This invention relates to non-prescription reading glasses, and more particularly, a package containing the reading glasses, which package allows the reading glasses to be tried on and tested prior to purchase.

It is now a common practice to sell non-prescription reading glasses directly to the consumer at pharmacies and other retail outlets. The non-prescription reading glasses are displayed in a retail establishment on free-standing displays.

Typically, a consumer selects a pair of non-prescription reading glasses from the display by trying on a number of pairs until he locates a pair that is suitable, from the standpoint of comfort, magnifying ability and appearance. In order to determine the appropriate magnifying ability for the reading glasses, charts are placed on the displays for the reading glasses. The charts have increasing sizes of print, and the purchaser of the reading glasses is instructed to stand approximately 14 inches (35.6 cm.) from the chart. When viewing the chart, the consumer will look at each line of print, and note the first line of print that appears to be out of focus. By reading across the chart, the consumer can then determine the amount of magnification needed for the reading glasses. The amount is expressed in diopters, an optical unit of measurement.

Once the consumer determines the appropriate amount of magnification needed, the consumer will then view all of the glasses on the display rack that have lenses at the appropriate diopter rating. The consumer can then select a pair of reading glasses which the consumer finds to be attractive and comfortable.

An improvement over the use of the chart for determining the proper amount of magnification needed is disclosed in U.S. Pat. No. 5,861,941, which issued on Jan. 19, 1999. That patent discloses a vision tester that is incorporated into a display rack, which vision tester accurately determines the appropriate magnification needed for the non-prescription reading glasses contained on the display rack. The display rack includes a number of vertically and horizontally spaced supports for the non-prescription reading glasses, which supports are shown in greater detail in U.S. Pat. No. Des. 374,786, which issued on Oct. 22, 1996.

An improved vision tester, for use on a display rack, is disclosed in U.S. Pat. No. 6,257,724, which issued on Jul. 10, 2001. That vision tester was invented by one of the inventors herein.

The eyeglass support of U.S. Design Pat. No. 374,786, which design was also invented by one of the inventors herein, has been found to be aesthetically pleasing and functional, in that it effectively supports non-prescription reading glasses that are to be displayed and vended from the display. However, it has been found in practice that placing the eyeglasses on the support is not always precisely done when a consumer tries on a pair of eyeglasses and has to put them back on the support. The support requires that the temples be received in slots, but the consumer does not always place the temples in the slots, thereby having the eyeglasses placed in an imprecise manner on the support.

Prior to the invention of the support shown in U.S. Design Pat. No. 374,786, various other supports were developed for vending eyeglasses. These supports are shown in U.S. Pat. Nos. 4,976,532, 5,056,668 and 5,100,006. Although the supports shown in these patents appear to be effective for holding and displaying eyeglasses, they all require that precision be shown in placing the eyeglasses on the support.

An improvement on the support shown in U.S. Pat. No. 374,786 is shown in U.S. Pat. No. 6,302,369, which issued on Oct. 16, 2001. One of the inventors herein was a co-inventor of the invention shown in that patent.

In all of the vending displays disclosed in the aforementioned patents, the non-prescription eyeglasses are accessible to be freely handled by the potential consumer. This can lead to a dirtying of the lenses, and possible damage to the reading glasses. Additionally, because the reading glasses are relatively small, and will easily fit into a pocket, there is always the risk of pilferage.

The package of this invention contains the reading glasses within the package, from which they cannot readily be removed. The package is relatively large compared to the size of the reading glasses, and will not readily fit into a pocket. This can substantially reduce the risk of pilferage.

While the reading glasses are in the package, they can be tried on, and the consumer can test the reading glasses for appropriate magnification.

Another advantage of placing the reading glasses in the package is that they can be vended along with a protective case, which is also within the package. The package is transparent, and the case is readily visible through the wall of the package. The case is decorative, and this lends to the commercial appeal of the combination of the reading glasses and the case.

SUMMARY OF THE INVENTION

A transparent plastic package containing a pair of non-prescription reading glasses. The temples of the reading glasses pass through openings in the rear wall of the package. The package includes a nose notch. The reading glasses can be tested by a consumer, while in the package, by opening the temples, placing her nose in the notch and placing the temples over her ears. The consumer can then look through the lenses of the reading glasses, to test them for proper magnification.

DESCRIPTION OF THE DRAWINGS

Objects and many of the attendant advantages of this invention will become readily appreciated as the same becomes better understood by reference to the following detailed description, when considered in connection with the accompanying drawing, wherein.

DETAILED DESCRIPTION OF THE PREFERRED EMBODIMENT

Figure 1:
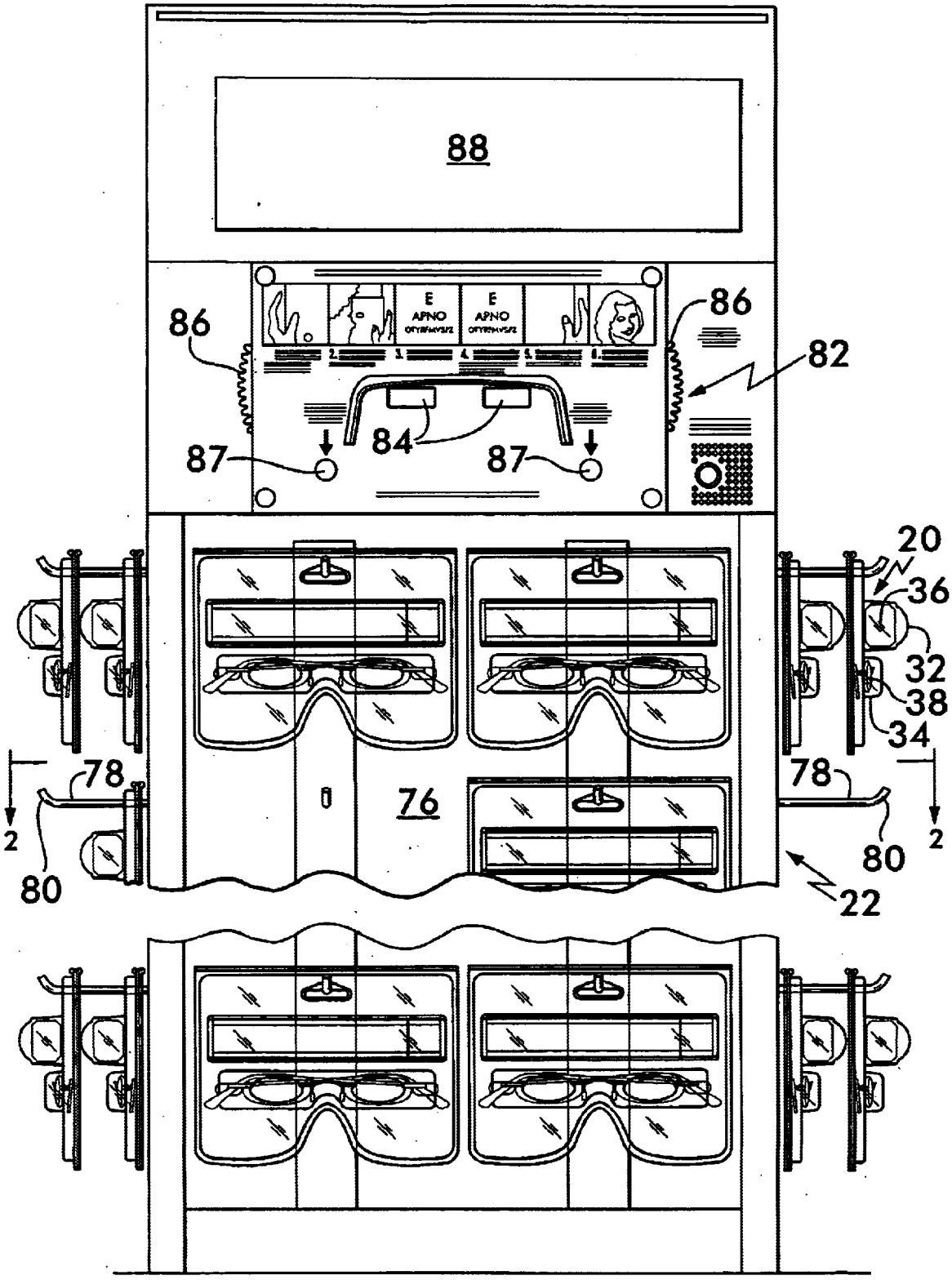
FIG. 1 is an elevational view, partially broken away, showing a display rack carrying a plurality of the packages of this invention.

Referring now in greater detail to the various figures of the drawing, wherein like reference characters refer to like parts, a package containing non-prescription reading glasses embodying the present invention is generally shown at 20 in FIG. 1. The package 20 is shown as it would be vended on a non-prescription reading glass display rack 22.

Figure 4:
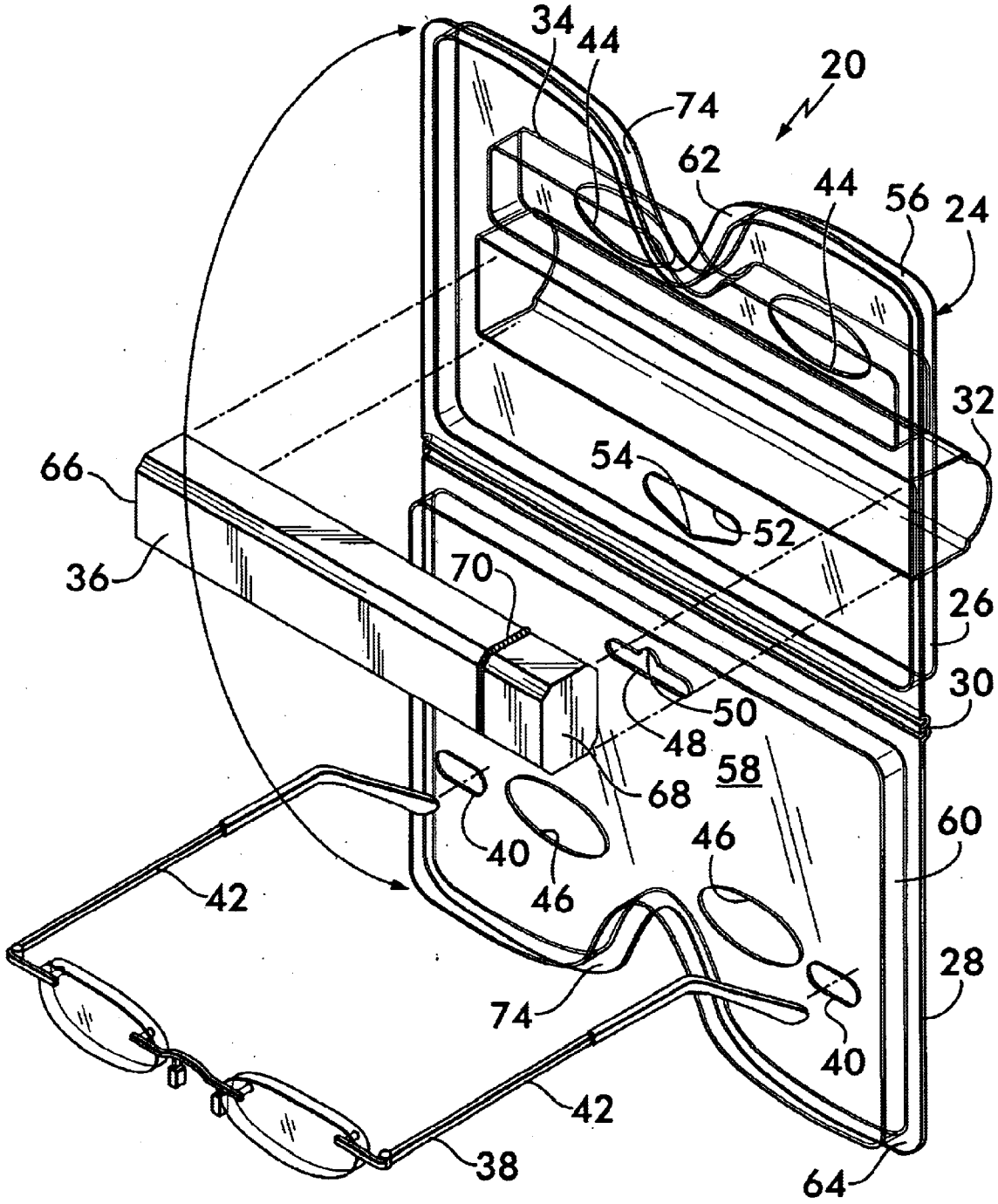
FIG. 4 is an exploded perspective view showing the package in its open condition, and with the contents removed.
Figure 5:
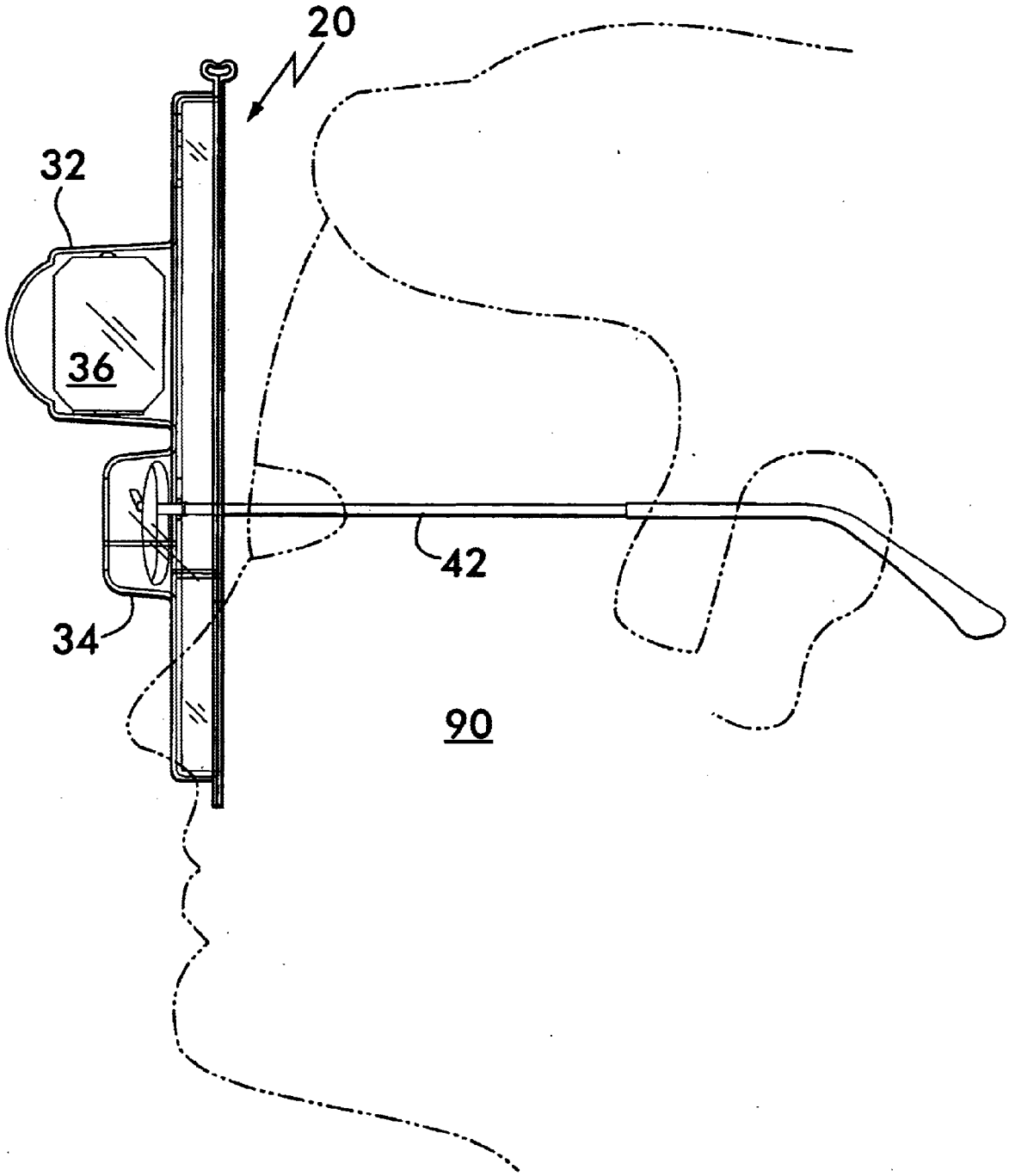
FIG. 5 is an elevational view showing a consumer testing the non-prescription reading glasses while in the package.

Referring now to FIGS. 4 and 5, the package 20 comprises a transparent container 24 having a front section 26 and a rear section 28. The front and rear sections are linked by a deformable hinge 30, which is molded unitarily with the front and rear sections.

Figure 3:
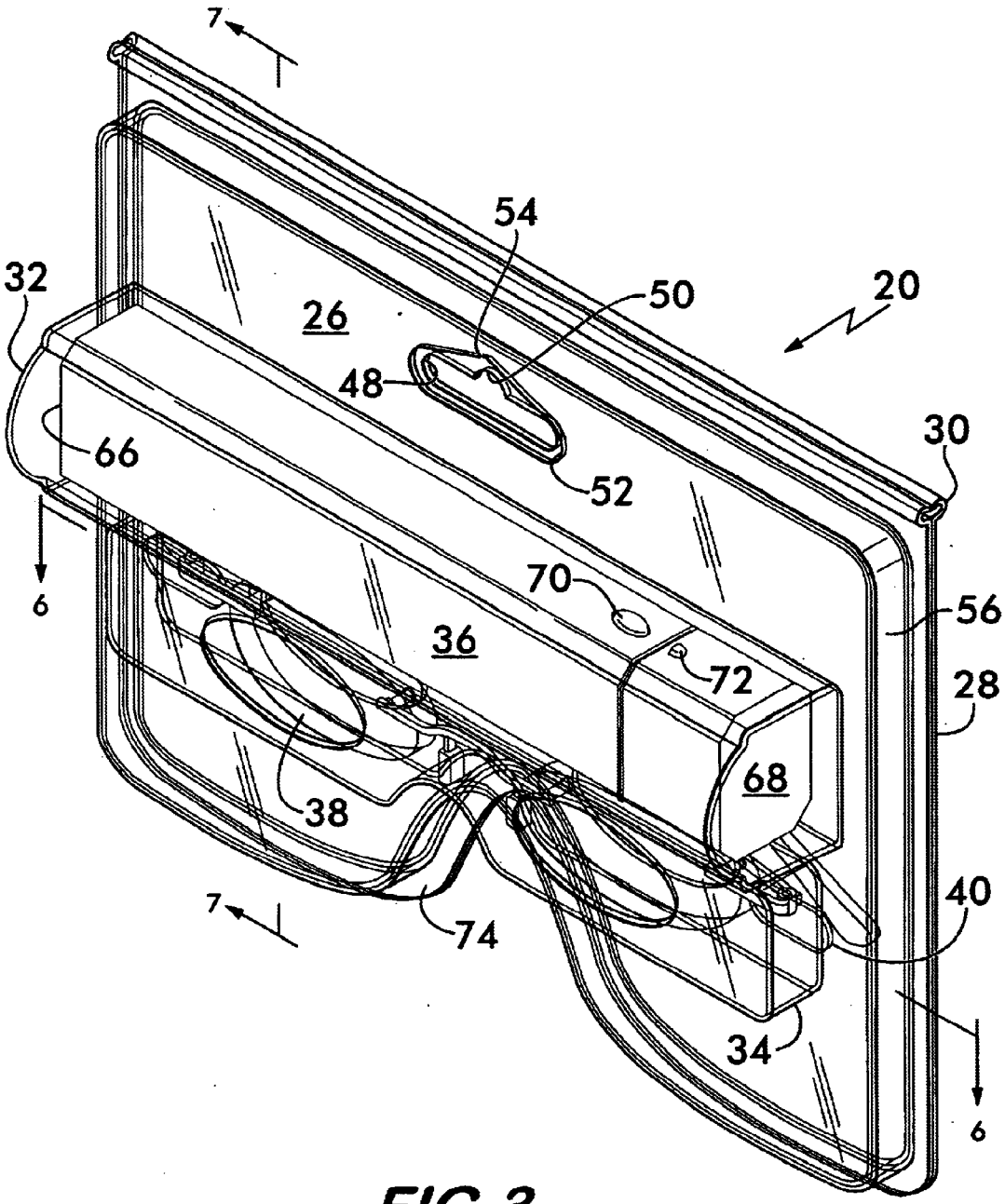
FIG. 3 is a perspective view of the package of this invention, including the non-prescription reading glasses and case.

Front section 26 contains an upper cavity 32 and a lower cavity 34 (FIG. 3). Upper cavity 32 is adapted to receive a case 36 for the reading glasses and lower cavity 34 is adapted to receive a pair of non-prescription reading glasses 38. Rear section 28 contains a pair of aligned, spaced openings 40. Temples 42 of the reading glasses 38 are adapted to pass through openings 40, when the package 20 is assembled.

A pair of oval openings 44 are cut in front section 26 and a pair of openings 46 are cut in rear section 28. A slot 48 is cut in rear section 28, with the slot containing an upper notch 50. A slot 52 is cut in front section 26. As seen in FIG. 3, slot 52 has upwardly inclined walls which terminate at an apex 54. Front section 26 has a wall 56 that extends around its entire perimeter. Rear section 28 has a planar front surface 58 which is supported by a wall 60 extending around its entire perimeter. A lip 62 extends outwardly from wall 56 and a lip 64 extends outwardly from wall 60.

The container 24 is formed from a transparent, thermoplastic material. It is vacuum thermoformed from a flat sheet of the material. During the thermoforming, the cavities 32 and 34 are formed, as are the walls 56 and 60. The hinge 30 is also formed in the thermoforming process.

Any transparent thermoplastic material can be used in forming the container. A preferred material is polyvinyl chloride. Containers of the type shown at 24 are commonly used in the food packaging industry, and the design is generally referred to as a clam shell design. The food containers have a hollow top and bottom, and not the specific shape of the container of this invention.

After the container has been thermoformed, the openings 40, 44 and 46, and the slots 48 and 52 are cut, by any of the conventional means known to the art. A preferred method is die cutting, but any other conventional cutting means can be used.

The eyeglass case 36 is adapted to hold the eyeglasses 38, when the case and eyeglasses are removed from the container 24, after purchase. The specific structure of the eyeglass case forms no part of this invention, and any case that is adapted to hold eyeglasses can be used in carrying out the invention. In the embodiment shown, the eyeglass case comprises an elongated container 66 (FIG. 4) with a cap 68. As seen in FIG. 4, the cap 68 is mounted on the container 66 by a spring hinge 70. As seen in FIG. 4, the case 36 is rotated 180° from the position shown in FIG. 3.

Referring to FIG. 3, the elongated container 66 includes a depressable pushbutton 71 which is spring-loaded from within the container. The pushbutton is mounted on a leaf spring, with the opposite end of the leaf spring containing a nib (not shown). A covered recess 72 is formed in cap 68. The nib of the leaf spring is received in the recess 72, thereby keeping the cap in the closed position shown in FIGS. 3 and 4.

When it is desired to open the case 36, pushbutton 71 is depressed. This releases the nib from the recess 72, and the case pops open through the urging of spring 70.

The case 36 can be formed from any rigid materials, such as plastic or metal. A preferred metal is anodized aluminum. Utilizing anodized aluminum permits the case to be made from various decorative colors. When metal is used for the case, the case can contain a soft liner, to prevent any damage to the glasses 38. The case can also be molded from plastic, with or without the use of any springs. Thus, the cap can merely be pulled off the elongated container, in the same manner as removing the top form a toothbrush container. Although the specific nature of the case forms no part of this invention, by utilizing the anodized aluminum, decorative cases can be formed, and this would add to the commercial appeal of the package.

In assembling the package 20, the case 36 is placed in cavity 32 and the eyeglasses 38 are placed in cavity 34. When placing the eyeglasses within the cavity, the temples are placed through the openings 40 (FIG. 4). The rear section 28 is then folded toward front section 26, around the hinge portion 30. The wall 60 of the rear portion is received within the wall 56 of the front portion, thereby giving the closed condition of the package, shown in FIG. 3. There is a tight fit between the walls, and when the packaging is closed, the front and rear sections remain in the position shown in FIG. 3. They can only be separated by pulling the sections apart, by grasping the lips 62 and 64.

As seen in FIGS. 3 and 4, walls 56 and 60 are contoured in their centers, to form a notch 74. As seen in FIG. 3, when the package is closed, the notches in the respective walls are nested, to give the package the finished appearance shown in FIG. 3.

Figure 6:
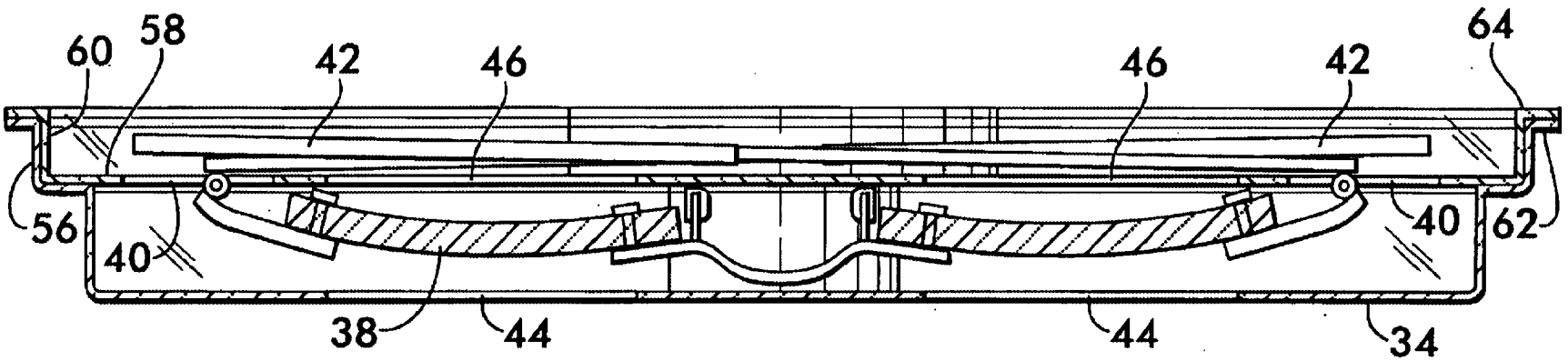
FIG. 6 is an elevational view taken along the line 6—6 of FIG. 3.

Referring to FIG. 6, it is seen that when the package is closed, and suitable for vending, the temples 42 are folded against the back of surface 58. The temples are protected by the walls 56 and 60. With the package and the temples in the position shown in FIGS. 3 and 6, the package is ready for vending.

The package 20 can be vended from any display rack known to the art. It can also be placed on a support separate from a display rack. The novelty of this invention resides in the package, and not the specific structure used for vending the package.

Figure 2:
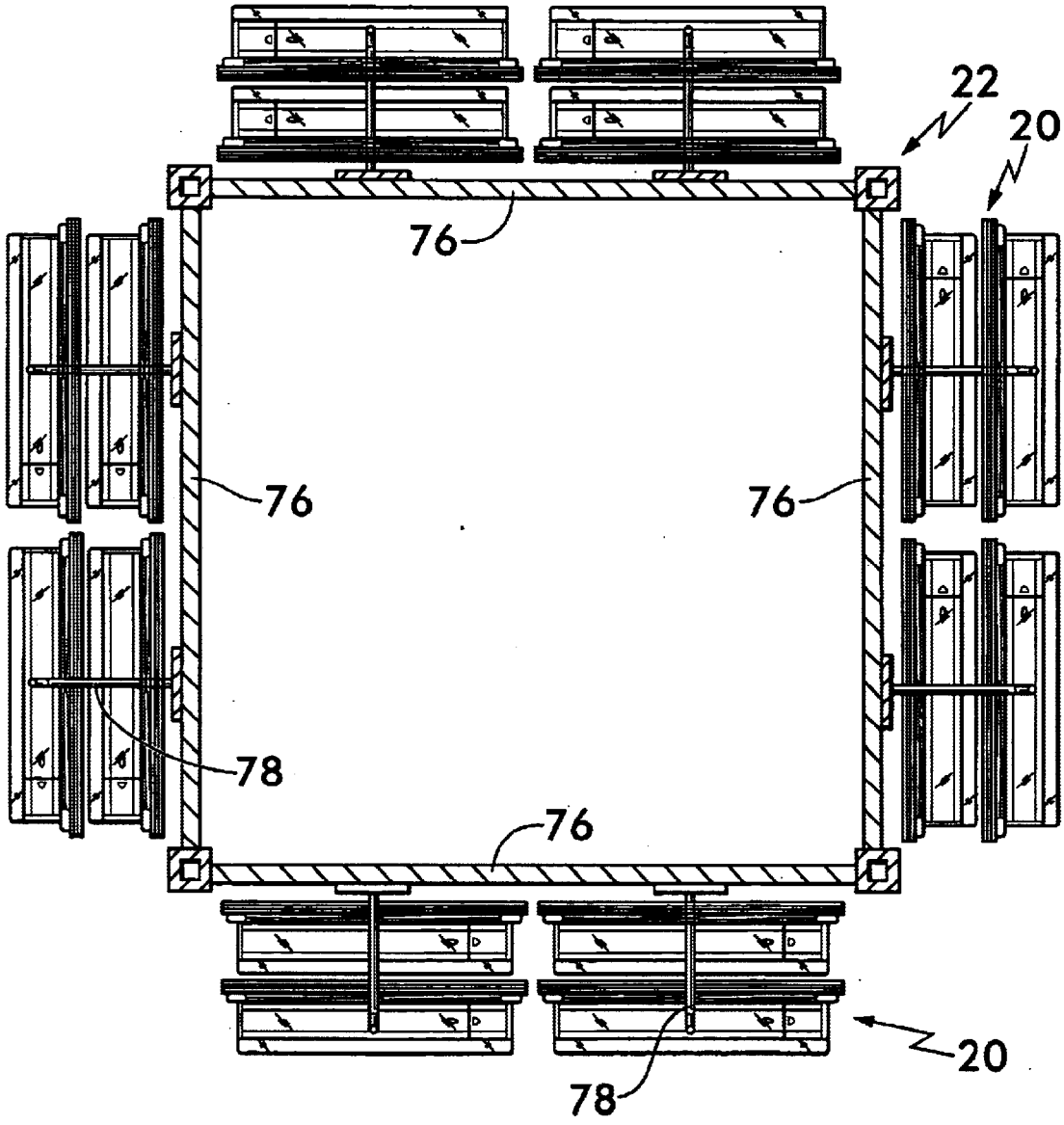
FIG. 2 is a sectional view taken along the line 2—2 of FIG. 3.

A display rack that can be used for displaying and vending the package 20 is shown at 22 in FIGS. 1 and 2. As seen in FIG. 2, the display rack is square in cross-section, and has vertically extending walls 76. Each of the walls has two vertically extending rows of support rods 78 projecting horizontally therefrom. As seen in FIG. 1, each support rod 78 has an upwardly projecting end 80. The support rods 78 are vertically spaced, and are each adapted to receive two packages 20.

The packages are suspended from the rods by having the rods pass through aligned slots 48 and 52. The notch 50 ensures that the package is centered on the rod, and will hang with the walls of the package being vertical, as seen in FIG. 1. As further seen in FIG. 1, the case 36 and eyeglasses 38 are outermost, when the packages are hung on the display rack. This permits a customer to readily inspect the contents of the package.

When a potential customer desires to purchase a pair of non-prescription reading glasses, she will first determine the magnification power, or diopter rating, which is required, by utilizing the vision tester generally shown at 82 in FIG. 1. The details of the vision tester are disclosed in aforementioned U.S. Pat. No. 6,257,724. The vision tester forms no part of this invention. The magnification power needed for the eyeglasses of the package 20 can be determined by any of the means known to the art, including the vision tester shown or standing a predetermined distance from an eye chart.

In utilizing the vision tester 82, the customer will place her face against the front of the vision tester and look through openings 84. This will enable the customer to view an eye chart. The lenses positioned behind the openings can then be changed by rotating two wheels 86. Once the appropriate diopter rating for the lenses is determined, utilizing the vision tester 82, the diopter ratings will appear at the openings 87.

After the consumer determines the appropriate diopter rating for the reading glasses, she will then view all of the glasses on the display rack that have lenses at the appropriate diopter rating. The consumer can then select a pair of reading glasses which she finds to be attractive and comfortable. The case will also play a part in the consumer's ultimate selection. A mirror 88 is provided to permit the consumer to view the eyeglasses on her face, thereby determining suitability from an appearance standpoint.

As is standard in the art, the eyeglasses 38 on the display rack are segregated by diopter rating of the lenses. The consumer will view only that segment of the display rack that contains eyeglasses having the appropriate diopter rating.

Figure 7:
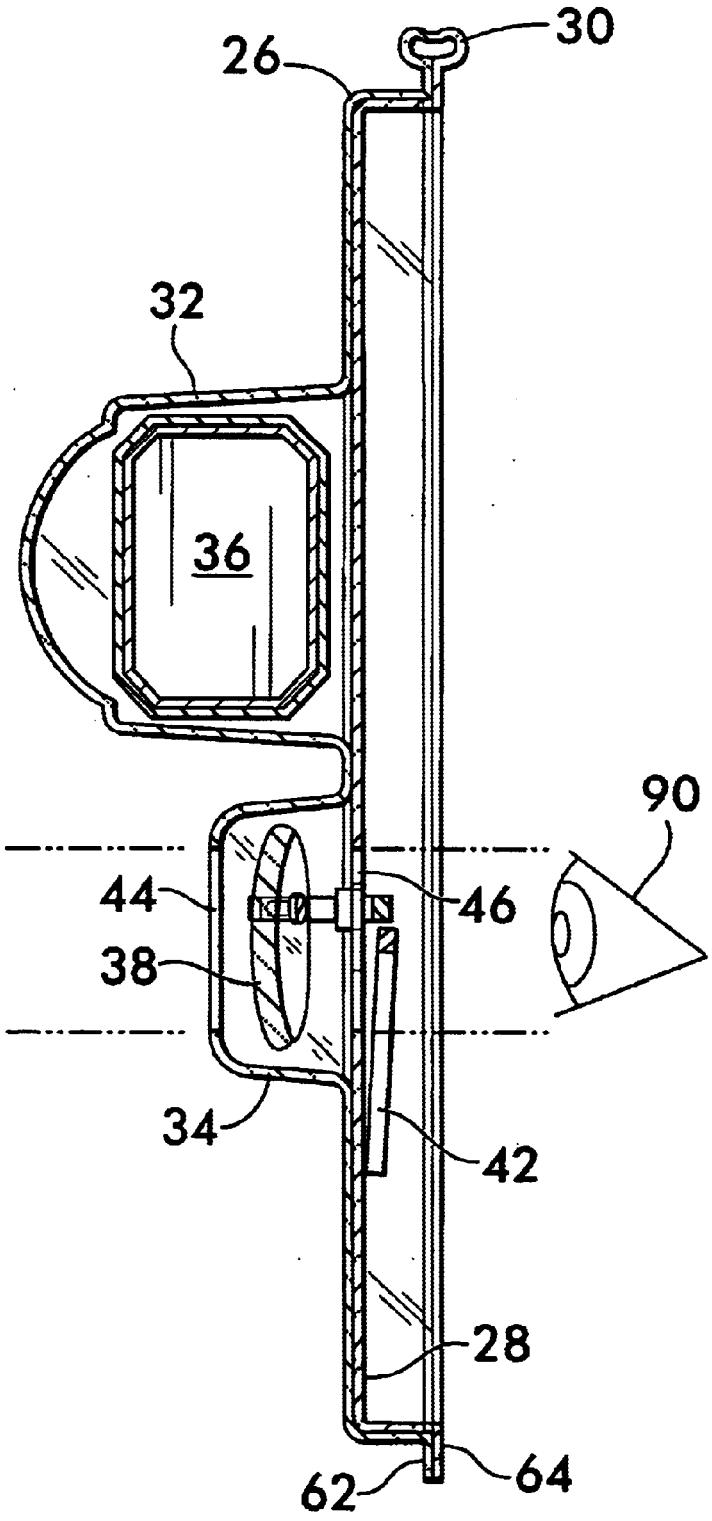
FIG. 7 is a sectional view taken along the line 7—7 of FIG. 3.

One of the features of this invention is that the eyeglasses can be tried on, without removing them from the container 24. As seen in FIG. 6, the temples 42 project through openings 40, and are positioned on the exterior of the closed container. When it is desired to try on the glasses, the temples 42 can be rotated outwardly and the entire package 22 can be placed on the nose of a consumer, schematically shown at 90 in FIG. 5. The nose of the consumer is received in notch 74 (FIGS. 3 and 4) and the temples 42 are placed over the consumer's ears. As seen in FIG. 7, when the package is in the position shown in FIG. 5, the consumer can look through the lenses of the eyeglasses 38. The openings 44 and 46, which are aligned, present an unobstructed view through the lenses. Although the temples are shown in the folded condition in FIG. 7, when the package is placed on the consumer's face, the temples are opened to the position shown in FIG. 5.

With the package in the position shown in FIG. 5, the consumer can then view the appearance of the glasses in the mirror 88 of the display rack. More importantly, with the glasses in place, the consumer can test whether the glasses have the appropriate magnification, by reading print at the normal distance that the consumer would hold printed materials from his eyes.

Although the container 24 has been shown with eye openings 44 and 46, it is possible to eliminate the openings. Since the container is formed from a transparent plastic, it is possible to look through the lenses of the glasses to test their magnification power, while having the container covering the front and rear surfaces of the lenses. The advantage of not having the openings is that the lenses will have more protection when being handled by consumers. The advantage of having the openings is that a clearer view can be obtained through the lenses, when the consumer tries the glasses on.

Figure 8:
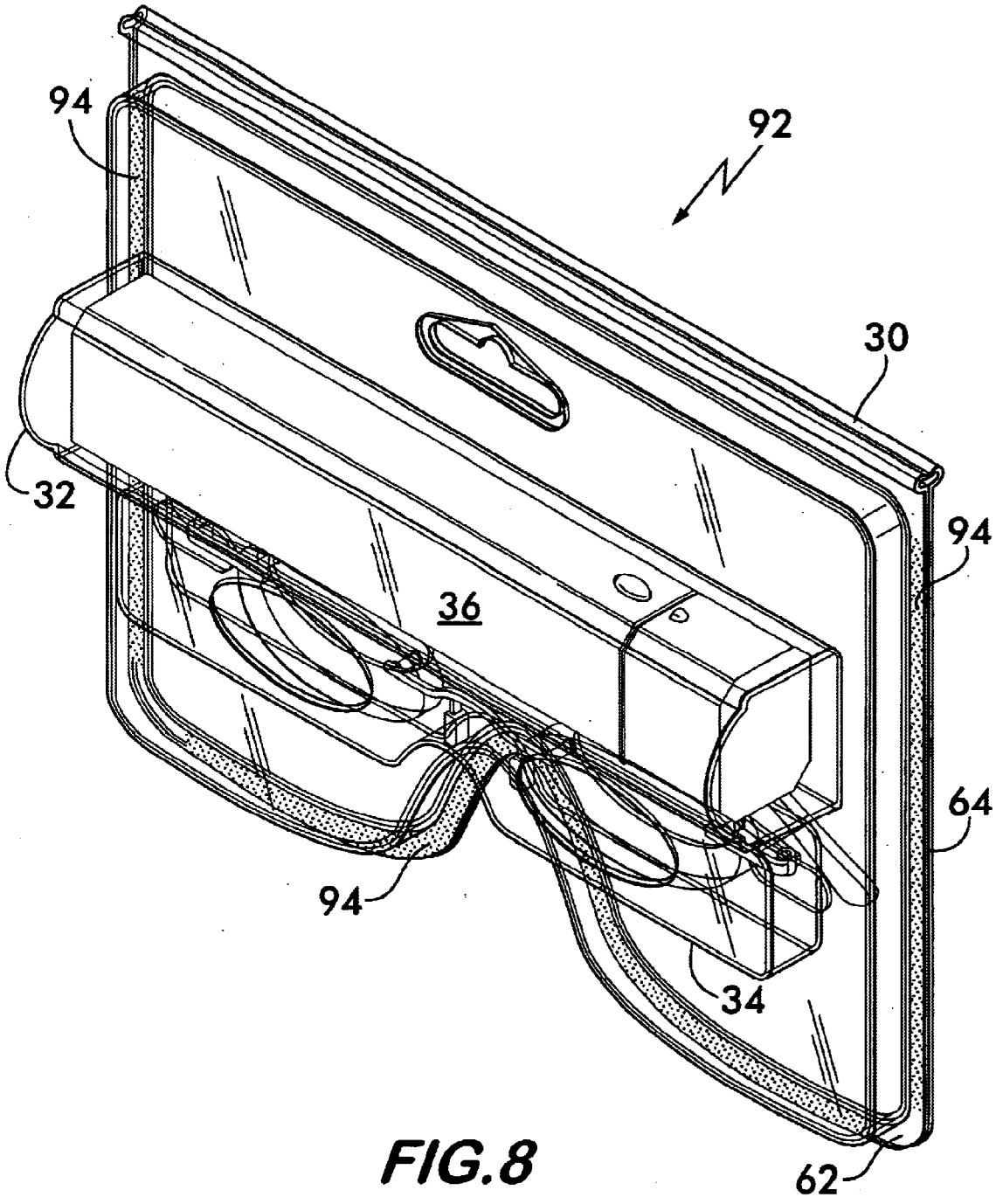
FIG. 8 is a perspective view of the package of this invention, with the two walls of the package being partially heat sealed together.

An alternate embodiment of the package of this invention is generally shown at 92 in FIG. 8. The package 92 is identical to the package 20, with the exception of the fact that the lips 62 and 64 are heat sealed together by spaced heat seals shown at 94. The heat sealing can be line seals shown at 94, or spot sealing at separate spots along the lips 62 and 64.

The package 20 will function for its intended purpose without the use of the heat seals. The friction fit of the rear section 28 within the front section 26 maintains a secure closure, which cannot be inadvertently opened. Adding the heat seals does provide an additional element of security, in that the heat seals prevent a consumer from opening the package and removing the contents. The heat seals can only be opened by cutting, which would make it far more difficult for a consumer to attempt to open a package in the store, without being detected.

Various indicia can be placed on the package 20 or the package 92. These indicia can include the trademark of the supplier of the package, and, more importantly, the diopter rating of the glasses being vended. The indicia can be placed on the package by adhesively securing a label to the outside of the front section 26 or securing the label within the container 24, by adhesively securing it to the upper portion of the planar surface 58 of the rear section 28. When secured there, it will be viewable through the upper portion of the front section 26, in the area above the cavity 32. The indicia can also be applied by any other means known to the art, such as an insert card placed between the sections 26 and 28.

It is thus seen that the package of this invention provides an attractive and secure container for displaying and vending non-prescription reading glasses and an associated case. The package can be used without the case, although having an attractive case to protect the glasses does provide a commercial appeal for the package. Since the glasses will be subjected to less handling by consumers while in the package, the shelf life of the glasses can be extended significantly. Glasses which are openly placed on display racks, and are subjected to continuous handling by potential consumers, can be damaged.

The package of this invention can be the only display of non-prescription reading glasses within a store. The package can also be part of a larger display, where reading glasses are still sold unpackaged, with the package being the only manner of obtaining a case for the reading glasses. Thus, both packaged and non-packaged reading glasses can be sold from the same display.

Without further elaboration, the foregoing will so fully illustrate this invention that others may, by applying current or future knowledge, readily adapt the same for use under various conditions of service.

We claim:

1. A package for non-prescription reading glasses comprising a container having a front and a rear, a pair of non-prescription reading glasses within said container and a case for said non-prescription reading glasses, said case being positioned separately from said reading glasses within said container and said case and said reading glasses being visible to a consumer through said container, said reading glasses being held within said container, said reading glasses having their temples pass through openings in said container and being adapted to be folded against a rear face of said container, said temples being further adapted to be opened to project perpendicularly from said container, said container being adapted to be placed over the nose of a potential customer when said reading glasses are within said container, and with said temples being adapted to be placed over the ears of the potential customer, with the lenses of said reading glasses being viewable through said rear of said container and through said front of said container.

2. The package of claim 1, wherein said container has a transparent front face.

3. The package of claim 1, wherein said container is formed from a transparent plastic.

4. The package of claim 3, wherein said transparent plastic is polyvinyl chloride.

5. The package of claim 1, wherein said container includes a first cavity, with said case being positioned within said cavity.

6. The package of claim 5, wherein said container includes a second cavity, said reading glasses being positioned in said second cavity.

7. The package of claim 1, wherein said container is formed from a front section and a rear section, said sections having a unitary hinge between them, and said rear section being received in said front section, and held in place by a friction fit.

8. The package of claim 7, wherein said rear section is additionally held within said front section by heat welds.

9. The package of claim 1, wherein said container includes a to including a slot, said slot being adapted to be placed over a supporting rod, for suspending said package from said rod, which rod is a part of a display rack.

10. A display rack and a package for non-prescription reading glasses displayed thereon, said package comprising a container having a front and a rear, a pair of non-prescription reading glasses within said container and a case for said non-prescription reading glasses, said case being positioned separately from said reading glasses within said container and said case and said reading glasses being visible to a consumer through said container, said reading glasses being held within said container, said reading glasses having their temples pass through openings in said container and being adapted to be folded against a rear face of said container, said temples being further adapted to be opened to project perpendicularly from said container, said container being adapted to be placed over the nose of a potential customer when said reading glasses are within said container, and with said temples being adapted to be placed over the ears of the potential customer, with the lenses of said reading glasses being viewable through said rear of said container and through said front of said container, said container being suspended from a rod projecting from said display rack.

11. The display rack and package combination of claim 10, and further including a plurality of spaced rods on said display rack, with a plurality of said packages suspended therefrom.

* * * * *